United States Patent [19]

Carroll

[11] 4,274,239

[45] * Jun. 23, 1981

[54] BUILDING STRUCTURE

[75] Inventor: Frank E. Carroll, Barrington, Ill.

[73] Assignee: Carroll Research, Inc., Rolling Meadows, Ill.

[ * ] Notice: The portion of the term of this patent subsequent to Oct. 17, 1995, has been disclaimed.

[21] Appl. No.: 952,057

[22] Filed: Oct. 17, 1978

Related U.S. Application Data

[63] Continuation-in-part of Ser. No. 720,353, Sep. 3, 1976, Pat. No. 4,120,131.

[51] Int. Cl.[3] ..... E04B 5/52

[52] U.S. Cl. ..... 52/443; 52/338; 52/309.8; 52/731; 52/282

[58] Field of Search ..... 52/338, 405, 480, 481, 52/309.8, 309.9, 443, 329, 330, 331, 282, 814, 738, 731

[56] References Cited

U.S. PATENT DOCUMENTS

| | | | |
|---|---|---|---|
| 2,233,054 | 2/1941 | Heeren | 52/338 X |
| 3,203,146 | 8/1965 | Carter | 52/338 X |
| 3,320,704 | 5/1967 | Forsythe et al. | 52/338 X |
| 3,496,691 | 2/1970 | Seaburg et al. | 52/450 X |
| 4,106,245 | 8/1978 | Lowe | 52/282 |
| 4,120,131 | 10/1978 | Carroll | 52/405 X |

*Primary Examiner*—Price C. Faw, Jr.
*Assistant Examiner*—Carl D. Friedman
*Attorney, Agent, or Firm*—Thomas W. Speckman

[57] ABSTRACT

This invention relates to a sheet metal structural shape for use in building construction having a generally box shape with outwardly extending flanges at one end of the substantially parallel sides and inwardly extending flanges at the other end of the parallel sides forming turned inward ends of the inwardly extending flanges and a closure between the ends of the outwardly extending flanges closing the space between the sides at that end. The sheet metal structural shape may be advantageously used as a structural shape in deck structures and in wall structures according to this invention. One deck structure of this invention uses the sheet metal structural shape as a sub-purlin, or purlin on short spans, supporting insulation on the bottom outwardly extending flanges and having roofing material fastened to the inwardly extending flanges at the top end of the structural shape. Thus, a deck is provided with at least a major portion of the insulation beneath the roof decking. The wall structure of this invention provides a wall which may be entirely erected from one side, providing especially suitable shaft and exterior wall construction.

24 Claims, 7 Drawing Figures

Fig. 5.
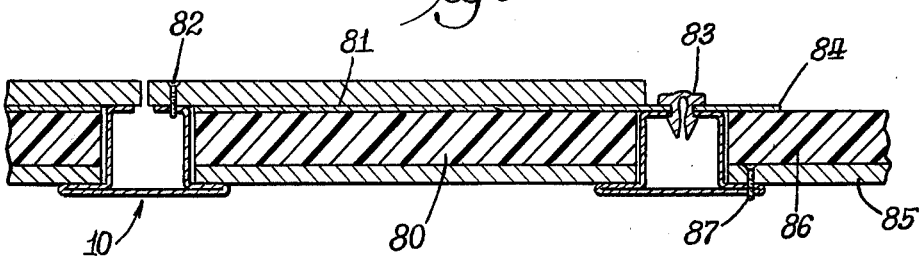
Fig. 6.
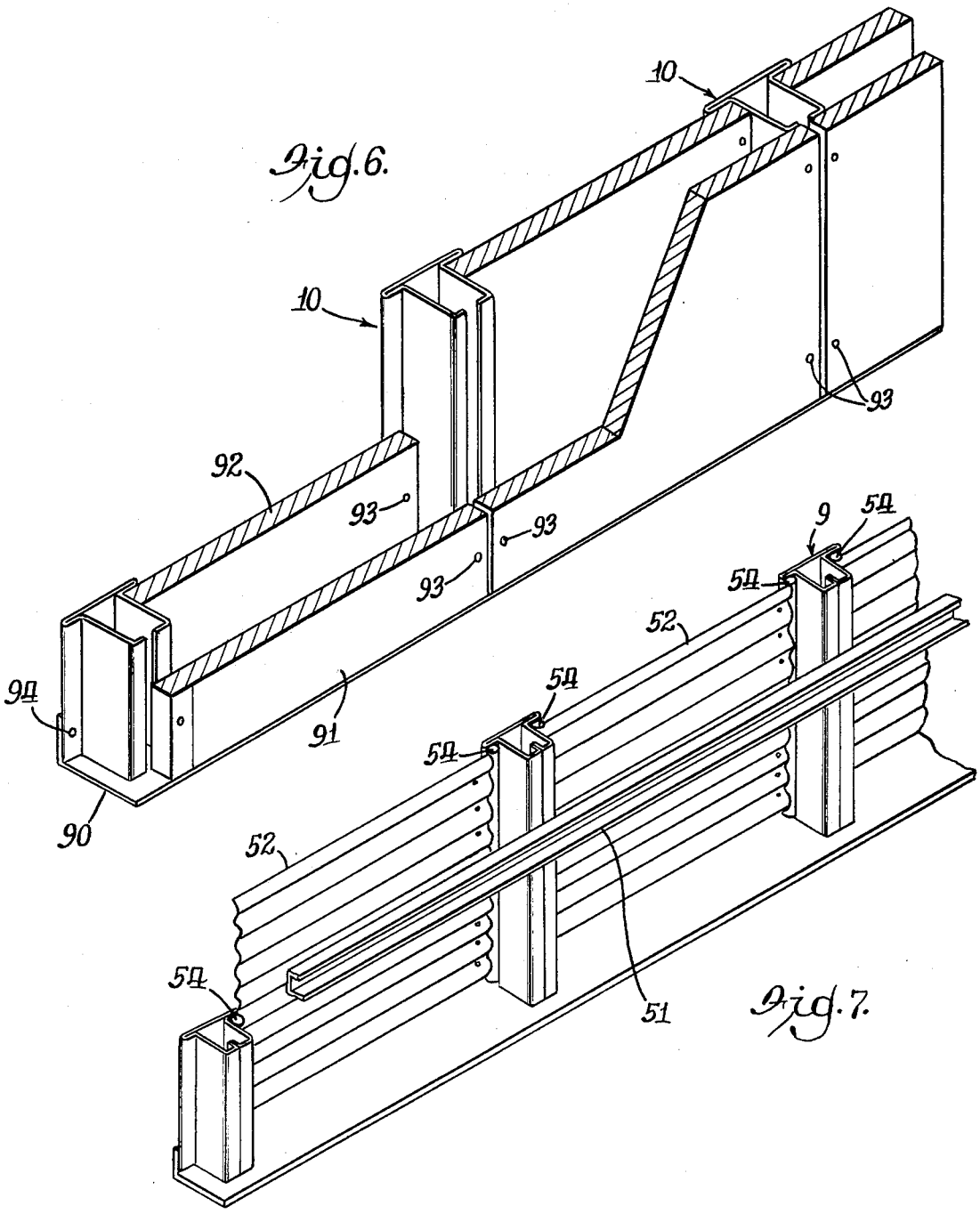
Fig. 7.

BUILDING STRUCTURE

CROSS REFERENCE TO RELATED APPLICATION

This is a continuation-in-part of my pending application, Ser. No. 720,353, filed Sept. 3, 1976, to issue as U.S. Pat. No. 4,120,131 on Oct. 17, 1978.

This invention relates to a sheet metal structural shape and its use in building structures. The sheet metal structural shape of this invention is advantageously used as a sub-purlin or as a purlin in insulated deck structures according to this invention. One roof structure according to this invention uses the sheet metal structural shape as a sub-purlin supporting insulation beneath sheet metal roofing material above which may be placed a weather seal built-up roofing either alone or in combination with additional insulation material. The sheet metal structural shape of this invention may also be advantageously used in fire resistant insulated poured deck structures and in precast or prefabricated deck structures. The sheet metal structural shape of this invention may also be advantageously used as a stud or mullion in interior or exterior building wall construction.

Previously, integral insulation properties were most frequently obtained when conventional metal roof decks were installed covered to the exterior by foam or other roofers' insulation covered with a weatherproof barrier or traffic layers, such as bitumen and roofing felt. Breaks in the weatherproof barrier lead to direct contact of the insulation with water. Such structures do contribute to the spread of a fire in a building under such a metal roof deck. U.S. Pat. No. 3,466,222 is illustrative of recent attempts to overcome such disadvantages. However, the structure shown in the 3,466,222 patent only slows down fire damage and does not eliminate it, the roof being susceptible to total destruction by the foam disintegrating and permitting the weatherproofing materials to burn even when utilizing an expensive metal deck roof system.

Another attempt to provide insulated metal deck structures is the deck system as described in U.S. Pat. No. 3,844,009 wherein perforated corrugated metal deck is fastened to joists, lightweight insulating concrete is poured upon the metal deck to the top of the corrugations, an insulation board having moisture permeable openings therethrough which prevent passage of concrete through the openings is laid and another layer of concrete is poured above the insulation extending through the openings. A weatherproof roofing is then applied to the exterior of the poured slab. This system has the disadvantages of wet concrete dripping through the metal deck, poor ceiling appearance, no accoustical correction and poor uplift resistance.

Poured gypsum roof deck systems have long been recognized as economical and furnishing a fireproof roof structure. In the conventional poured gypsum roof deck system, gypsum formboard is laid over the steel sub-purlin assembly, a layer of interwoven steel reinforcing mesh placed over the gypsum formboard and poured in place slurry of gypsum concrete applied to conventionally two inches thick. Such roof systems are known to provide satisfactory two hour fire ratings and low flame spread ratings. However, many earlier attempts to provide insulation to such roof deck systems have not proved entirely satisfactory. One attempt has been to use perlite aggregate in the gypsum concrete, however, this does not give desired insulation properties. Another attempt has been to provide insulation beneath the roof deck structure, such as in the ceiling structure, however, such insulation either adds to combustion in the interior of the building or is expensive if incombustible mineral fiber is used. Other attempts to provide both satisfactory insulation and fireproof properties have been to utilize formboard which is both fireproof and has insulating properties. Such formboards are those manufactured from mineral fiber materials and fiber glass materials, but these are both expensive and do not provide the desired insulation properties while being more difficult to use in field erection.

The sheet metal structural shape of this invention provides deck structures wherein the insulation is held by the sheet metal structural shape beneath a metal roof deck, providing both desired insulation qualities and accoustical correction. In embodiments of this invention using insulation beneath a metal roof deck, the insulation is further protected by the metal deck from breaks in the weather seal which has caused water-soaking of insulation in previous attempts to insulate metal roof decks.

The wall construction according to this invention provides erection processes wherein all of the structural steel, the studs or mullions, may be completely erected and the wall material applied thereafter from one side. This is especially important in shaft wall construction wherein it is important to effect early closure of a dangerous open shaft. Previous methods of shaft wall erection, such as disclosed in U.S. Pat. No. 3,702,044, require that the closure walls and the studs be erected together by fitting the wall board into the slot of the stud creating a dangerous work environment at the edge of a shaft.

It is an object of this invention to overcome the above disadvantages.

It is an object of this invention to provide a sheet metal structural shape which may be advantageously used in both deck construction and wall construction.

It is another object of this invention to provide sheet metal purlins and sub-purlins suitable for corrugated metal decks and for poured and prefabricated insulating roof decks.

It is yet another object of this invention to provide a metal roof deck structure which has insulation beneath the metal roof deck providing an accoustical and finished ceiling treatment.

It is a further object of this invention to provide an economical insulating and fireproof poured concrete roof deck system.

It is yet another object of this invention to provide a wall structure well suited for interior and exterior building wall construction which is particularly well suited for shaft wall construction.

These and other objects, advantages and features of this invention will be apparent from the description and by reference to the drawings wherein preferred embodiments are shown as:

FIG. 5 is a sectional view of a wall structure according to one preferred embodiment of this invention;

FIG. 6 is a perspective cutaway view of another preferred embodiment of a wall structure according to this invention; and FIG. 7 is a perspective cutaway view of another preferred embodiment of this invention showing an exterior wall structure using corrugated siding.

The sheet metal structural shape of this invention provides excellent structural characteristics while reducing weight and providing a structural shape which can be readily fabricated from sheet metal. It is highly desirable to fabricate structural shapes from sheet metal to minimize energy requirements in production and to conserve steel. Many prior attempts to utilize sheet metal shapes in poured roof construction have not been satisfactory. Some prior attempts have utilized sheet metal shapes as substitutes for bulb tees in roof deck construction. These sheet metal shapes while providing sufficient strength in the composite assembled poured roof do not have satisfactory strength characteristics themselves and in the erection, bend over or roll when walked upon by the erectors. This results in a very dangerous situation for the workers. The sheet metal structural shapes of this invention provide desirable strength characteristics themselves and sufficient strength characteristics to be walked upon during erection without dangerous bending or rolling.

Figure 1:
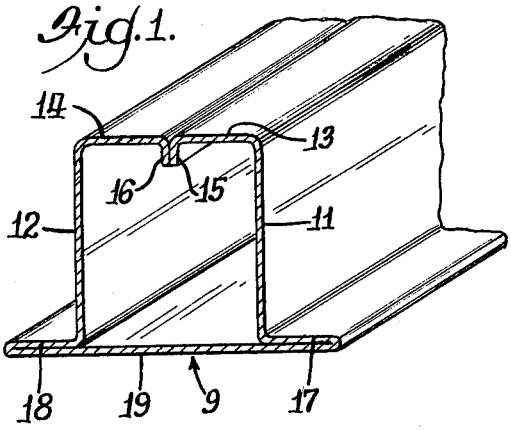
FIG. 1 is a perspective sectional view of a sheet metal structural shape according to one embodiment of this invention.

Referring to FIG. 1, one sheet metal shape utilized in this invention is shown as flanged box section 9 symmetrical about a bisecting plane having opposing generally parallel and equal length sides 11 and 12, a flange extending outwardly at substantially 90° from one end of each of sides 11 and 12, base closure 19 extending from the outermost end of one outwardly extending flange 18 to the outward end of the other outwardly extending flange 17 forming a closure between parallel sides 11 and 12, and flanges 13 and 14 projecting inwardly from the other end of sides 11 and 12, respectively, the terminal ends 15 and 16 of flanges 13 and 14, respectively, turned inwardly adjacent each other. The flow of concrete into the shape when desired may be enhanced by holes, shown as 21 in FIG. 2, in sides 11 and 12. Flanges 17 and 18 extend outwardly from the ends of walls 11 and 12, respectively, which are adjacent bottom closure 19. The depth of the sheet metal structural shape may be about two inches to about four inches suitable for use as a sub-purlin or a purlin for short spans and for an interior stud or an exterior wall mullion. The width of the box portion, or spacing between parallel sides, may be about 1¼ to about 3 inches suitable for use as sub-purlins, purlins, interior studs or exterior wall mullions. Flanges 17 and 18 may vary in length suitable to support the desired insulation or roof structure. These flanges are formed of the sheet metal being doubled back on itself making the flanges double thickness. The flanges extend outwardly from each of the side walls about ½ to 1½ inches. It should be recognized that the above dimensions are governed by conventionally desired strength characteristics and to accommodate conventional deck or wall materials. The dimensions may be outside of the above ranges to obtain out-of-the ordinary strength or special material holding qualities. I have found the structural shape indicated as 9 having turned inwardly adjacent ends 15 and 16 of flanges 13 and 14, respectively, is especially useful in preventing distortion of the shape when walked upon as in erecting the dry corrugated deck shown in FIG. 3. Structural shape 9 is especially useful when lighter gauges of metal are used, providing good footing for walking during erection. The shape having an open slot between the terminal ends of flanges 13 and 14, indicated as 10 and shown in FIG. 2, is especially useful in grouted decks as shown in FIG. 2 and in wet poured decks as shown in FIG. 4.

The sheet metal structural shapes of this invention may be fabricated by well known roll forming techniques from sheet metal of about 22 gauge to about 12 gauge. It is preferable to use galvanized, commercial grade steel of 16, 18, 20 and 22 gauge.

Figure 2:
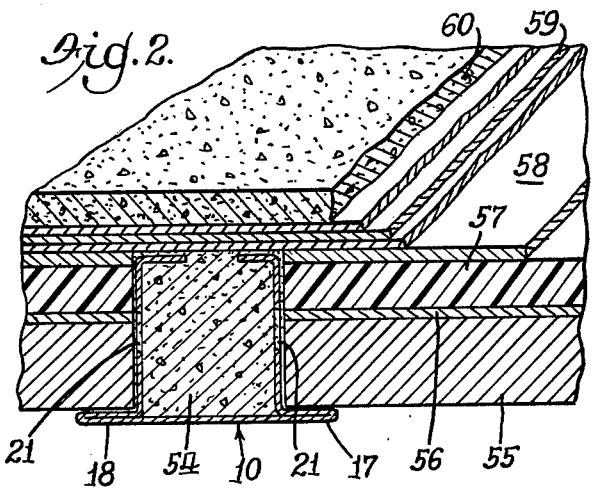
FIG. 2 is a perspective cutaway view of one embodiment of an insulated precast roof deck according to one embodiment of this invention.

FIG. 2 shows an embodiment of deck construction according to this invention using precast decking. In FIG. 2 sub-purlins 10 are shown with precast structural decking 55 resting upon the lower outwardly extending flanges 17 and 18 of sub-purlin 10. The precast deck structure 55 may be any suitable precast concrete structure or precast wood fiber cement-bonded board roof decking. Preferably insulation 57 is synthetic polymer foam insulation as further described below, with incombustible gypsum boards 56 and 58 both below and above the foam to enhance fire resistance of the deck structure. Fire resistance of the deck structure is enhanced by grout 54 which fills the interior of sub-purlin 10, flows through holes 21 in the parallel side walls of the sub-purlin and fills the space adjacent the sub-purlin and the prefabricated decking and insulation. Holes 21 also aid in drying of the mortar within the box shape. Built-up roofing of the tar and tar paper layers are shown as 59 and weather seal coating 60 when the deck is to be used as a roof deck. The sub-purlin of this invention provides high fire resistance to structures utilizing prefabricated decking due to its being filled with grout material and thereby providing substantial encasement of the metal sub-purlin structure and increasing its structural strength.

Figure 3:
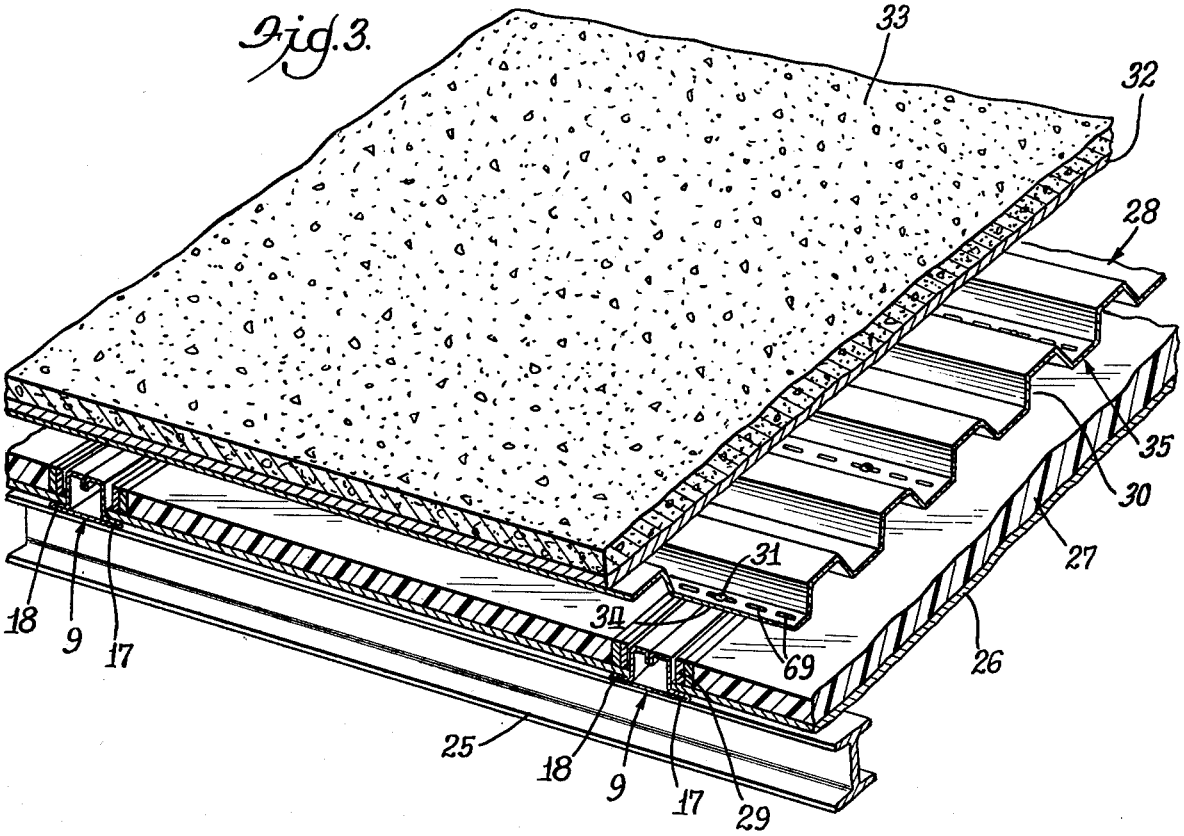
FIG. 3 is a perspective cutaway view of one embodiment of an insulated dry corrugated roof deck according to one preferred embodiment of this invention.
Figure 4:
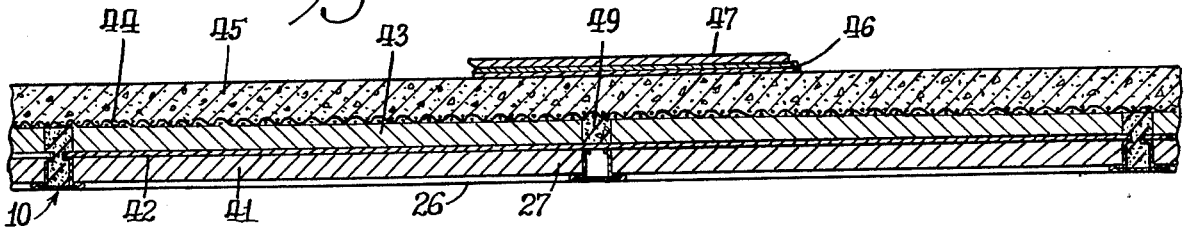
FIG. 4 is a sectional view of an insulated poured concrete roof deck according to one embodiment of this invention.

FIG. 3 shows one preferred insulated dry corrugated deck structure according to this invention. FIG. 3 shows sheet metal structural shape 9, used as a sub-purlin, resting upon building structural beam 25. Following erection of building structural beams 25, sub-purlins 10 may be secured to the beams 25 by tack welding or other suitable attachment means at desired spacings to provide suitable strength characteristics and to accommodate insulation between adjacent sub-purlins. The insulation is laid between adjacent sub-purlins resting upon bottom flanges 17 and 18. As shown, formboard 26 rests upon lower flange 17 and supports insulation 27 above it. Any formboard providing desired strength characteristics of at least supporting its own weight and the weight of insulation 27 over the span between shapes, fire resistance and if desired, acoustical correction, may be used in the structure of this invention. Formboards for use in the dry structure as shown in FIG. 3 may be moisture permeable or impermeable and combustible or non-combustible as required. Gypsum, fiberglass, wood fiber, mineral fiber and asbestos cement formboards are suitable. Gypsum formboards, especially those having fire resistant additives such as vermiculite or perlite with fiberglass reinforcing, are especially suitable when plastic insulation is used. When conventional gypsum formboards, without the high temperature resistant additives, have been used in the structure of this invention in conjunction with synthetic polymer insulation above the formboard, the conventional gypsum formboard has cracked and fallen from its position between the sub-purlins allowing molten plastic insulation to fall through upon exposure to flames. This can be overcome by use of gypsum board with fire resistant additives.

FIG. 3 shows insulation 27 located above formboard 26. Any suitable insulation material may be used. Conventional mineral wool, mineral fiber or fiberglass batting type or slab insulation may be used. An especially preferred insulation is synthetic organic polymer foam which provides good insulation properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Particularly suitable foams are closed cell foams which provide high insulating properties and low internal permeability to moisture. Such organic polymer foams are substantially rigid bodies of foam and are well known for their low density and outstanding thermal insulating properties. Previously, use of organic polymer foams in roof structures has been limited due to the need for care and special attention in installation if they are used alone and due to their decomposition at higher temperatures permitting structural damage. In accordance with this invention these disadvantages are overcome and polystyrene may be advantageously utilized.

The organic polymeric foam and the formboard are preferably preassembled by fastening the foam to the formboard by use of synthetic and natural adhesives or foaming the polymer in place. Suitable synthetic adhesives include epoxy, polyurethane, polyamide and polyvinylacetate and its copolymers. It is particularly desirable, since many of the formboards particularly suited for this invention are porous, to foam the organic polymer foam in place on top of the formboard in a plant operation. Such techniques are well known to the art. When the foam is foamed in place on top of a porous formboard, the foam will penetrate the pores of the formboard providing good adhesion between the foam and formboard layers and providing good waterproofing for the top surface of the formboard.

In some instances, where the insulation has sufficient rigidity and fire resistance, formboard 26 may be eliminated and the insulation rested directed upon flange 17. A particularly suitable insulation material for use in this manner is mineral fiber insulation board such as mineral fiber boards constructed of plastic bonded mineral fibers with an integral glass fiber mat facing reinforced with parallel glass fiber strands as sold by Forty-Eight Insulations, Inc., Aurora, Illinois, under the trademark ALOYGLAS. This type of fiber board has a melting point at about 1600° F. as compared with conventional fiberglass formboard which melts at about 1050° F. The mineral fiber insulation board used in the structure of this invention should have a density of about 9 to 12 pounds per cubic foot. This type of mineral fiber board may also be used as formboard 26 with foam insulation adhered to the top, providing maximum insulation and acoustical correction characteristics. The thickness of the insulation when used alone or the insulation and the formboard should be such that the top of the insulation is approximately level with or below the top of the inwardly projecting top flanges 13 and 14 of sub-purlin 9.

The dry deck structure as shown in FIG. 3 may be totally insulated by pouring loose insulation such as perlite or vermiculite into the space between sides 11 and 12 of the structural shape. Also, fire resistance may be enhanced by insulation 27 being spaced from the sides of the structural shape and one or more fire resistant strips of gypsum board 29 inserted as shown in FIG. 3. A concrete slurry grout may also be used in lieu of strips of gypsum board 29.

FIG. 3 shows corrugated deck 28 which has upstanding portions 30 and corrugations 35. Machine-driven screws 31 securely hold sheet roof deck 28 in position and provide uplift resistance. Decking 28 may also have perforations 69 to permit ventilation. These perforations 69 aid in the drying of insulation (if any) above decking 28. Corrugated decking 28 may be metal or plastic. Utilization of the structure of this invention allows the use of thinner metal roof decks than previously used providing lightweight structures and further economies. Suitable gauges for use in the metal roof decks of this invention are about 22 to 28 gauge galvanized steel. Prior used metal roof decks were 18 to 22 gauge to accommodate the greater distance between joists or purlins. The metal decks may be 18 to 28 gauge, but the lighter gauge provide a more economical and lighter weight deck. Use of sub-purlins in the structure of this invention permits use of the lighter gauge metal decking. Prior structures using metal decks required different lengths of decking to accommodate different joist spacings. The structure of this invention uses metal decking of a single length as a result of uniform sub-purlin spacing.

In the embodiment of the deck structure shown in FIG. 3, gypsum sheathing or other suitable insulation board, is placed above metal roof deck 28 with a weather seal coating 33 applied to exterior when the deck is used as a roof deck. The built-up roofing membrane may comprise alternate layers of roofing felt and hot asphalt with a waterproof wearing surface of tar and gravel. Any suitable waterproof wearing surface for flat type roofs is suitable for the roof structure of this invention.

If desired, additional insulation may be placed between sheathing 32 and waterproof roof coating 33 or between sheathing 32 and metal deck 28. When additional insulation is used in this fashion, it is preferred that the insulation be one of the synthetic polymer foams set forth above with an additional layer of gypsum formboard between the insulation and the weather seal roofing material. When insulation is placed above deck 28, drying from breaks in the weather seal is enhanced by perforations 69, holes 35 and the general passage of air containing moisture through box shapes 10. The use of water permeable insulation 27 and formboard 26 also facilitates drying of insulation in the deck structure.

Insulated metal decks of the structure as shown in FIG. 3 have obtained hourly fire ratings without any ceiling below. Prior to this invention, metal roof decks having more than about 1 inch equivalent fiberglass insulation with a fire rated suspended ceiling beneath have not, to my knowledge, obtained hourly fire ratings. The deck construction of this invention, as shown in FIG. 3, may provide an hourly fire rated insulated deck over a fire rated suspended ceiling. To obtain the hourly fire rated deck of the structure shown in FIG. 3, high temperature gypsum board (fire rated gypsum board) must be used in combination with insulation material which melts or vitrifies at low temperatures, such as polystyrene or urethane insulation board. While I do not wish to be bound by the theory of obtaining hourly fire ratings, it appears that melting of the polystyrene at about 220° F. or the vitrifying of the urethane at higher temperatures reduces the insulation sufficiently to permit the heat built up between the suspended ceiling and roof to dissipate to the outside before the steel fails. The high temperature fire rated gypsum board retains its integrity and controls dripping of the molten polystyrene. A fire damaged roof may be repaired by replacement of the melted polystyrene foam by a foamed in place material pumped in from the ends of the spaces between sub-purlins or by addition of insulation to the exterior of the metal deck. The holes and perforations in the metal deck also facilitate heat dissipation.

The roof structure of this invention as shown in FIG. 3, provides a metal roof deck system which is lightweight and provides high insulating qualities. The structure is extremely versatile with respect to extent of insulation and fire resistance qualities.

Corrugated plastic roofing material for use in the embodiment shown in FIG. 3 may be any polymeric material which provides for desired structural strength and retention of such properties without appreciable degradation from sunlight and weather. The polymeric sheet is both the structural component of the integrated deck structure of this invention and the weather surface. Any polymeric material meeting the above standards is suitable.

One particularly suitable thermoplastic corrugated sheet material is biaxially oriented corrugated polyvinyl chloride sheets. The biaxially oriented polyvinyl chloride sheets maintain good mechanical properties and light transmission property with sustained exposure to ultraviolet light and weathering. Further, the impact strength of the biaxially oriented polyvinyl chloride corrugated sheets is high and permits use of such sheet polymeric material as the structural component of roof decks. A particularly suitable biaxially oriented polyvinyl chloride corrugated sheet material is currently offered by Solvay & Cie SA, Brussels, Belgium, under the trade name Selchim HR. The production of these biaxially oriented polyvinyl chlorides is set forth in more detail in U.S. Pat. Nos. 3,661,994, 3,744,952, United Kingdom Pat. Nos. 1,353,447 and 1,365,041. Such materials are available permitting passage of the solar energy downward through the polymeric sheet roofing to the solar collectors or in various opaque colors which reflect the solar energy to enhance the insulation properties of the roof deck. It is seen from FIG. 3 that the corrugated sheet roofing may be screw applied to the upper flanges of the sub-purlin. After installation, the corrugations may be filled with any suitable caulk material to a level of upstanding portions 30. This seals the fastenings and provides a smooth, traffic-bearing roof surface. The exterior of the polymeric roofing provides the weather surface eliminating costly standard built-up roofing and its costly maintenance. The roof structure shown in FIG. 3, without built-up weather surface, provides a very lightweight, economical insulated roof deck structure.

The roof deck structure as described above may be readily adapted to the solar energy absorbing roof deck similar to that described in my U.S. Pat. No. 4,006,731. In the roof deck as shown in FIG. 3 of the present application, the solar energy absorber plate is placed adjacent the top of insulation 27 to absorb solar energy passing through the polymeric roofing. Pipes carrying a heat transfer fluid from the absorber plate may be conveniently placed within structural shape 9. Suitable solar energy reflecting surfaces as described in my earlier patent may be used.

The sheet metal structural shapes of this invention having open slots may advantageously be used in poured concrete roof deck systems as shown in one preferred embodiment in FIG. 4. FIG. 4 shows sub-purlins 10 with moisture permeable insulation board of formboard and insulation 26 and 27, respectively, resting upon their adjacent lower flanges as described with respect to FIG. 3. Moisture permeable formboard 42 rests upon the upper inwardly extending flanges 13 and 14 of alternate sub-purlins and has synthetic polymer foam or mineral fiber insulation on its upper surface providing open spaces 49 between adjacent strips of insulation and over the intermediate sub-purlins. While open spaces 49 are shown as slots, they may be holes of round or other shape of sufficient size to allow flow of concrete therethrough. It is also desired that the edges of the insulation at the end of the formboard above the structural shapes be set back from the edge of the formboard providing additional open space for concrete to flow into the structural shape greatly increasing its fire resistance. The open spaces should be about 5 to about 20 percent of the area of the formboard. The formboards for use in this embodiment are those moisture permeable formboards which have relatively high melting points and structural resistance to combustion and heat damage when used in the laminated fashion of this invention. Particularly suitable formboards are mineral fiber boards such as mineral fiber structural boards constructed of plastic bonded mineral fibers with an integral glass fiber mat facing reinforced with parallel glass fiber strands as sold by Forty-Eight Insulations, Inc., Aurora, Illinois, under the trademark ALOYGLAS formboard. This type of formboard has a melting point at about 1600° F. as compared with conventional fiberglass formboard which melts at about 1050° F. The mineral fiber formboard used in the structure of this invention should have a density of about 9 to about 12 pounds per cubic foot. Another suitable mineral fiber formboard is the rigid spun mineral fiber board such as sold by United States Gypsum Company under the trademark THERMAFIBER. Still another suitable formboard is the felted wet processed rock wool board such as sold by United States Gypsum Company under the trademark FIRECODE formboard. Asbestos cement formboards and gypsum formboards having fire resistant additives such as vermiculite or perlite with fiberglass reinforcing are suitable. The above formboards are referred to as high temperature resistant formboard. Reinforcing mesh 44 is placed above insulation 43 and may be fastened to sub-purlins 10 with any suitable clip to provide greater uplift resistance and a composite deck structure. Concrete 45 is poured above the insulation 43. Concrete 45 flows into openings 49 adjacent to formboard 42 and providing bottom drying for concrete 45 through formboard 42 if a weather seal is placed above concrete 45 prior to complete drying. Also, concrete 45 fills the interior portions of sub-purlins 10 providing excellent uplift resistance, fire resistance and additional strength to the sub-purlins. A concrete beam structure is formed with the sub-purlin as reinforcing. Built-up layers of tar and roofing paper shown as 46 may be applied above the concrete and wearing surface of tar and gravel 47 applied to the exterior of the built-up roofing.

The concrete utilized may be preferably standard gypsum concrete, however, modified concretes containing various fillers, such as perlite, aggregate for thermal insulation and lighter weight are suitable, but not necessary in the roof structure of this invention. Gypsum concrete is especially desirable for use in roof structures not only because it is incombustible but also because the gypsum concrete sets within a few minutes to form a slab that is hard enough to walk upon thereby permitting, in many cases, a waterproof wearing surface to be laid the same day the slab is poured. When any type of portland cement is used, the setting time is much slower. However, I have found that using the structure shown in FIG. 4, lightweight concrete may be poured over gypsum formboard which, to my knowledge, has not previously been possible. The lightweight concrete is especially suitable for the structure shown in FIG. 4.

The drying of the concrete continues by removal of moisture from the concrete for several weeks after pouring. I have found that in the deck structure of this invention the drying time of the concrete is not greatly increased over conventional poured deck. This results from the concrete being in direct contact with the formboard which is porous to water. The continued drying of the concrete after a built-up type roofing membrane is applied to its exterior, continues by the moisture escaping through the formboard. Weep holes or slots in the bottom and/or sides of the box shape permitting escape of moisture to aid in drying the concrete, but not permitting flow of concrete therethrough.

The roof structure of this invention as shown in FIG. 4, provides an economical roof structure having high insulating properties, two hour fire ratings and provides a structure in which insulation may be replaced if fire damage does result. Under high heat conditions the organic polymer foam may decompose. However, the concrete filling the vertical slots or holes through the foam and resting upon the gypsum formboard serve to support and unitize the roof structure even if the polymer foam completely disintegrates. The disintegrated foam may be replaced by a suitable foamed in place material.

The roof structure of this invention provides properties which are presently being called for by newer building regulations. The first such property is fire ratings which, following suitable ASTM testing, result in two hour fire ratings for the roof structure. The second important property is thermal insulation combined with the satisfactory fire rating. Present energy conservation considerations result in a "U" value of 0.10 and less being desirable. Calculations show that roof structures of this invention utilizing the sheet metal shape as a purlin and using polystyrene and gypsum concrete result in "U" values of 0.06 and less. When the sheet metal shape is utilized as a sub-purlin with ½ inch gypsum formboard, 1½ inch polystyrene foam board and 2 inch gypsum concrete the "U" value is 0.10. Thus, an inexpensive deck is provided having both a two hour fire rating for Class 1 fire rated construction and insulation properties resulting in "U" values of 0.10 and less. Further, a range of desired insulating properties may be achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides insulation and fireproof properties without any structure beneath it and may be left exposed. Further, when the sheet metal shape of this invention is used directly as a purlin, about one foot of interior occupancy space is gained over conventional construction using exposed joists which must also be fireproofed.

One preferred embodiment of a wall structure according to this invention is shown in FIG. 6. The wall structure shown in FIG. 6 is especially well suited for interior and shaft walls. The wall structure shown in FIG. 6 spans the distance between floors or between a floor and a ceiling or roof structure. The wall structure is erected by placing a suitable anchoring structure at the base of the wall, such as sill angle 94, and the corresponding structure at the top or a cap angle. Any suitable shape may be used which provides a backing against which to fasten the sheet metal studs 10 and not obstructing entry of the wall board from the narrow side of studs 10. For example, a channel may be used at the base and an angle at the top. Studs 10, being of sheet metal, may be readily cut to suitable length at the job site, erected at desired spacings and fastened to the sill structure at the bottom and the corresponding cap structure at the top. The sheet metal studs may be spot welded or attached in any other suitable fashion known to the art, shown as fastening means 94. It should be noted that in the structure of this invention, all of the studs may be put into place at the desired spacing as soon as the sill and cap structures are installed, thus, affording quick and safe protection of open shafts and the like. The studs may be completely installed from the building side of the shaft without the necessity for scaffolding or even leaning into the shaft area. After the spaced studs are erected, the inner shaft wall spaced studs are erected, the inner shaft wall filler board 92 may be attached to the studs from the building side of the shaft simply by placing the wall board against the flanges of the studs as shown in FIG. 6 and applying screws shown as 93 at desired locations through the inner shaft wall and into the stud flange.

Outer shaft wall 91 may be applied by placing the outer shaft wall board in the desired position and applying screws or other fastenings through the outer shaft wall board and the flat portion of the inwardly opposed flanges of the stud. Thus, the entire double wall assembly may be completely assembled from one side.

A preferred embodiment of a shaft wall is shown in FIG. 6 wherein the studs are spaced on centers of the width of standard available wall board. The inner shaft wall board 92 is cut narrower than the outer shaft wall board 91 to provide insert 97 which fits between the parallel sides of the structural shape thus providing additional fire resistance to the wall structure. Of course, the space between inner shaft wall 92 and outer shaft wall 91 as well as the interior of the structural shape may be filled with any type of insulation material desired. The wall closure material fastened to the flanges of adjacent structural shapes may be of any suitable material. As shown in FIG. 6, with particular reference to shaft wall construction, gypsum board may be used in interior construction. Alternatively, plywood, various composition boards, metal panels and a wide variety of composition panels with various desired interior surface finishes, may be used to obtain texture, color and accoustical properties. The wall construction of this invention is also suitable for exterior walls and in such cases, the wall closure material facing the exterior would suitably be a weatherresistant material and may be faced with any desired texture or colored material to obtain the desired appearance. In exterior construction as well as interior, the structural shape of this invention may be filled with any suitable insulation material or may be filled with gypsum concrete to provide added fire resistance.

FIG. 7 shows an exterior wall having mullions 9 and internal horizontal girts 51 to provide stiffening for horizontal forces. Corrugated siding 52 having horizontal corrugations, is applied in a single piece from bottom to top. The corrugated siding may be unrolled from the bottom between girts and flanges 53 and then screw fastened from the inside to flanges 53. Weatherseal 54 is provided between the siding and flanges. Plastic or metal corrugated material is suitable. For example, Venetian corrugated metal which is available in long rolls and surfaced in a variety of stone and brick textures may be readily cut to length at the job site and applied with self-tapping screws.

FIG. 5 shows another embodiment of a preferred wall of this invention. Studs or mullions 10 are spaced in parallel relationship to each other at the desired distance for structural strength and for spanning with wall board assembly comprising wall board 81 and insulation 80. The assembly may be screw applied as shown by screw 82 or be clip applied as shown by clips 83. In the cross-sectional view shown in FIG. 5, the space between adjacent mullions is filled by wall board 81 to which foam 80 with a suitable outer surface may be attached or foamed in place. Also shown in FIG. 5 is an alternate assembly wherein wall board 85 rests upon outstanding flanges of the stud and secured by fastening means 87. Insulation 86 is adhered to rigid decorative backing 84 which is prepunched for fasteners 83. Thus, it is seen that any suitable wall closure material may be used.

While in the foregoing specification this invention has been described in relation to certain preferred embodiments thereof, and many details have been set forth for purpose of illustration, it will be apparent to those skilled in the art that the invention is susceptible to additional embodiments and that certain of the details herein can be varied considerably without departing from the basic principles of the invention.

I claim:

1. A sheet metal structural shape for use in building construction which is symmetrical about a bisecting plane having:

opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides, the terminal ends of said inwardly projecting flanges turned inwardly in continuous longitudinal abutment with each other.

2. The sheet metal structural shape of claim 1 wherein the overall depth is about 2 to about 4 inches.

3. The sheet metal structural shape of claim 1 wherein the spacing between said parallel sides is about $1\frac{1}{4}$ to about 3 inches.

4. The sheet metal structural shape of claim 1 wherein said outwardly extending flanges are about $\frac{1}{2}$ to about $1\frac{1}{2}$ inches long.

5. The sheet metal structural shape of claim 1 formed from galvanized steel of about 16 to 22 guage.

6. The sheet material structural shape of claim 1 having openings in each of said parallel sides sufficiently large to permit the flow of mortar and concrete into the interior of the shape.

7. An insulated deck structure comprising:

a series parallel sheet metal structural shapes which are symmetrical about a vertical bisecting plane having:

opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides, the terminal ends of said inwardly projecting flanges turned inwardly adjacent each other;

corrugated structural decking above and resting upon the inwardly extending flanges of said structural shapes; and insulation board resting on said outwardly extending flanges and extending between adjacent structural shapes beneath said corrugated structural decking.

8. The insulated deck structure of claim 7 wherein said insulation board is mineral fiber.

9. The insulated deck structure of claim 7 wherein said insulation board consists of a lower rigid portion gypsum formboard having fire resistant additives and an upper portion of foam.

10. The insulated deck structure of claim 8 wherein said insulation board is a plastic bonded mineral fiber board having a density of about 9 to about 12 pounds per cubic foot.

11. The insulated deck structure of claim 7 wherein said insulation board consists of a lower mineral fiber formboard and an upper portion of foam.

12. The insulated deck structure of claim 7 wherein said structural decking is corrugated metal decking of about 22 to about 28 gauge thickness.

13. The insulated deck structure of claim 7 wherein said structural decking is corrugated plastic and serves as the weatherseal.

14. The insulated deck structure of claim 7 wherein the interiors of said sheet metal structural shapes are filled with insulation.

15. The insulated deck structure of claim 7 wherein said insulation board is spaced from the sides of said structural shape in its upper portion and one or more strips of fire resistant gypsum board filling said space.

16. The insulated deck structure of claim 7 wherein said insulation board is spaced from the sides of said structural shape in its upper portion and said space is filled with concrete slurry grout.

17. An insulated deck structure comprising:

a series of parallel sheet metal structural shapes which are symmetrical about a vertical bisecting plane having opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides a distance forming a slot between the terminal ends of said inwardly projecting flanges;

moisture permeable insulation board resting on said outwardly extending flanges and extending between adjacent structural shapes;

moisture permeable formboard resting on said inwardly extending flanges and extending between said slots of alternate structural shapes providing an open space through said slots into the interior of said shapes, thereby spanning intermediate structural shapes, and insulation secured to the upper surface of said formboard, said insulation having open spaces over said intermediate structural shapes;

wire reinforcing mesh above said insulation;

poured concrete above said reinforcing mesh flowing through said openings and contacting said formboard over said intermediate structural shapes and flowing into the interior of said alternate structural shapes forming an integrated roof deck structure resulting in reinforced beam structures including said alternate structural shapes; and a waterproof wearing surface to the exterior of the poured concrete.

18. The insulated deck structure of claim 17 wherein said open spaces are about 5 to about 20 percent of the area of the said formboard.

19. The insulated deck structure of claim 17 wherein the lower portion of said insulation board and said formboard is a high temperature resistant formboard.

20. The insulated deck structure of claim 17 wherein said conrete is gypsum concrete.

21. The insulated deck structure of claim 17 wherein said concrete is lightweight concrete.

22. The insulated deck structure of claim 17 wherein said structural shapes have holes or slots in the bottom or sides permitting escape of moisture for drying but not permitting flow of concrete therethrough.

23. A building wall structure comprising:

a spaced series of parallel sheet metal structural shapes which are symmetrical about a bisecting plane having:

opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides;

said structural shapes fastened to a holding structure at each end; and wall closure material adjacent to and between said outwardly projecting flanges of adjacent parallel shapes.

24. The wall structure of claim 23 wherein said sheet metal structural shapes are vertical and additionally have internal horizontal girts fastened to said inwardly projecting flanges and said wall closure material is horizontally corrugated siding.

* * * * *